US010792547B2

(12) United States Patent
Coln

(10) Patent No.: US 10,792,547 B2
(45) Date of Patent: Oct. 6, 2020

(54) GOLF BAG COLLAR

(71) Applicant: GOLFBAGPAL, INC., Lake Mary, FL (US)

(72) Inventor: Ronald Coln, Lake Mary, FL (US)

(73) Assignee: GOLFBAGPAL, INC., Lake Mary, FL (US)

( * ) Notice: Subject to any disclaimer, the term of this patent is extended or adjusted under 35 U.S.C. 154(b) by 0 days.

(21) Appl. No.: 16/390,756

(22) Filed: Apr. 22, 2019

(65) Prior Publication Data

US 2020/0023249 A1 Jan. 23, 2020

Related U.S. Application Data

(60) Provisional application No. 62/699,259, filed on Jul. 17, 2018.

(51) Int. Cl.
*A63B 55/50* (2015.01)

(52) U.S. Cl.
CPC ..... *A63B 55/50* (2015.10); *A63B 2209/08* (2013.01); *A63B 2209/10* (2013.01)

(58) Field of Classification Search
CPC ..... A63B 55/00; A63B 55/50; A63B 55/408; A63B 55/60; A63B 2209/08; A63B 2209/10; B60R 9/08
See application file for complete search history.

(56) References Cited

U.S. PATENT DOCUMENTS

| | | | | |
|---|---|---|---|---|
| 4,512,465 | A | 4/1985 | Jobe | |
| 4,753,344 | A | 6/1988 | Antonious | |
| 6,019,324 | A * | 2/2000 | Wu | B62B 1/045 224/274 |
| D517,808 | S | 3/2006 | Reimers et al. | |
| 10,569,716 | B1 * | 2/2020 | Law | A63B 55/50 |
| 2008/0190795 | A1 | 8/2008 | Shearon | |

* cited by examiner

*Primary Examiner* — Corey N Skurdal
(74) *Attorney, Agent, or Firm* — Allen, Dyer et al.

(57) ABSTRACT

A golf bag collar for securing around a golf bag when attaching the golf bag to a golf cart includes a first arcuate side member having a first end and a second free end, and a second arcuate side member being a mirror image of the first arcuate member and positioned opposing the first arcuate side member. The second arcuate side member also has a first end and a second free end. In addition, the golf bag collar includes a back member connecting the first end of the first arcuate member to the first end of the second arcuate member to define a central aperture, where the central aperture has a shape to fit around an outside of a golf bag and the first and second arcuate side members are held in place around the golf bag by a golf cart strap.

18 Claims, 4 Drawing Sheets

GOLF BAG COLLAR

CROSS-REFERENCE TO RELATED APPLICATIONS

This application claims priority to U.S. Provisional Application Ser. No. 62/699,259 filed on Jul. 18, 2018 the contents of which are herein incorporated by reference in their entirety.

TECHNICAL FIELD

The present invention relates to the field of golf, and, more particularly, to a golf bag collar for securing around a golf bag when attaching the golf bag to a golf cart.

BACKGROUND

Golf cart bag areas on golf carts are designed to accommodate various designs and sizes of bags on the market. This usually results in an area that is too large for most bags and this causes problems. Golf bags are designed to allow easy access to and storage of the clubs during a round of golf. This works nicely when the bag is attached and stands completely upright so a club can be pulled from the bag easily and returned in the same manner. However, the bag will not stand completely upright when the strap securing the bag to the cart pulls the bag to one side or causes the bag to collapse in the center.

In particular, often times a golf club gets stuck and hung up with other clubs in the golf bag due to the awkward angle of the golf bag on the cart. The clubs may list to the right or left depending on which side the golf bag is on the golf cart. The golf bag may also be collapsed in the center which happens with non-rigid bags that are designed with lighter material making them softer.

Accordingly, there is a need in the art for a golf bag restraint device for a golf cart that maintains the golf bag completely upright so that the clubs can be easily removed and replaced in the golf bag.

SUMMARY

In view of the foregoing background, it is therefore an object of the present invention to provide a golf bag collar for securing around a golf bag when attaching the golf bag to a golf cart. The golf bag collar includes a first arcuate side member having a first end and a second free end, and a second arcuate side member being a mirror image of the first arcuate member and positioned opposing the first arcuate side member. The second arcuate side member also has a first end and a second free end. In addition, the golf bag collar includes a back member connecting the first end of the first arcuate member to the first end of the second arcuate member to define a central aperture, where the central aperture has a shape to fit around an outside of a golf bag and the first and second arcuate side members are held in place around the golf bag by a golf cart strap.

The golf bag collar may have an outer cover over the first and second arcuate side members and the back member, where the outer cover comprises leather or plastic.

The golf bag collar may also include a first sleeve formed within the outer cover on the first arcuate side member proximate to its free second end, and a second sleeve formed within the outer cover on the second arcuate side member proximate to its free second end. The first and second sleeves extend at least partially to the first end of the respective arcuate side member in order to selectively secure a strap therethrough.

The second end of each of the first and second arcuate side members may also include a securement device for selectively securing the respective second ends of the first and second arcuate side members together. The securement device may include magnets, snaps, or hook and loop fasteners.

Top surfaces of the first and second arcuate side members and the back member may be substantially flat, and the back member substantially straight. In addition, the first and second arcuate side members and the back member may comprise a foam material.

In another particular aspect, a golf bag collar includes a U-shaped member comprising first and second legs connected by a rear portion, where the U-shaped member defines a central aperture to fit around an outside of a golf bag. A top surface of the U-shaped member is substantially flat and a back portion of the U-shaped member is substantially straight. In addition, the gold bag collar includes an outer cover over the U-shaped member.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
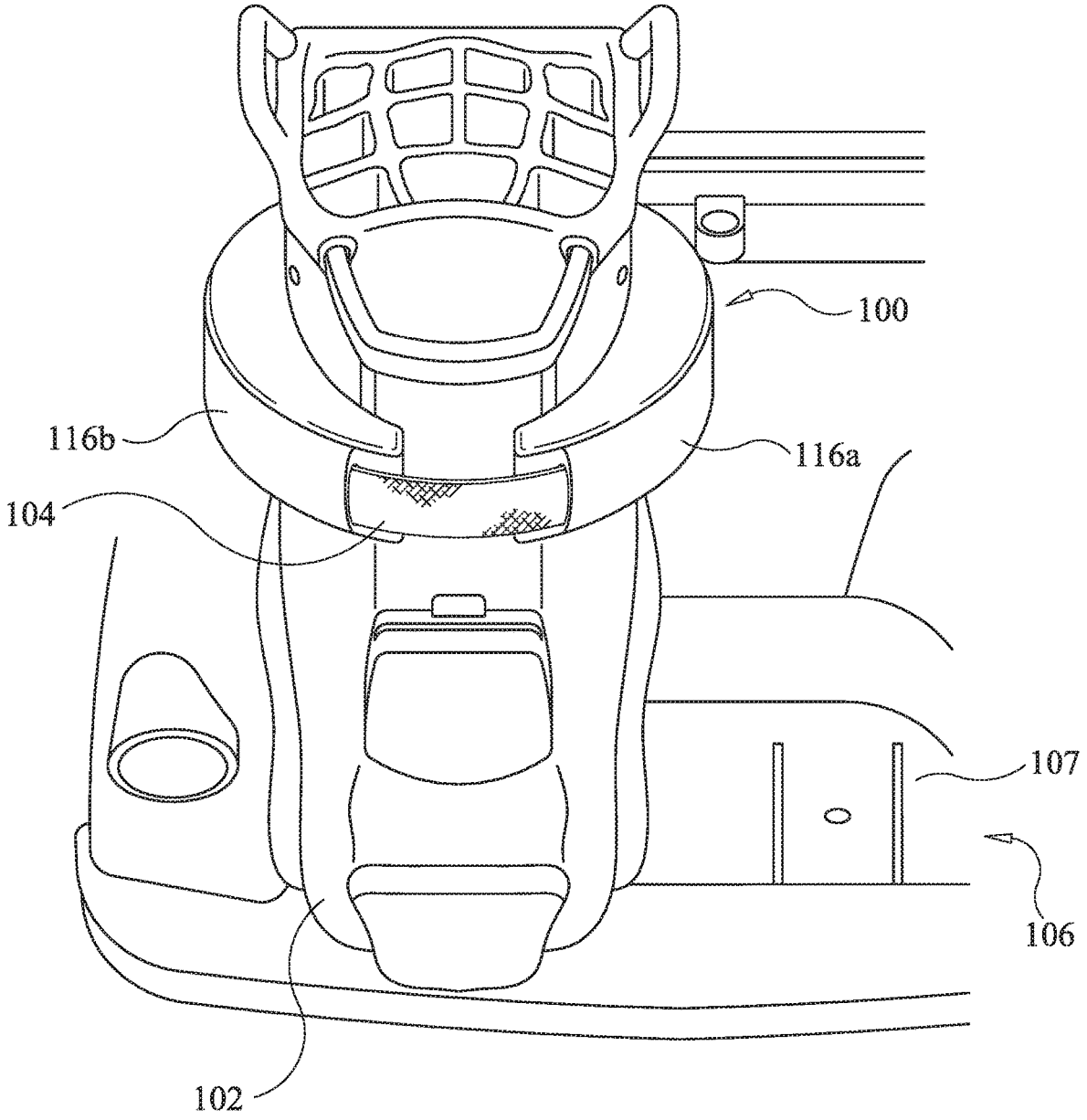
FIG. 1 is a front perspective view of a golf bag collar in accordance with a particular embodiment of the invention shown securing a golf bag to a golf cart.
Figure 2:
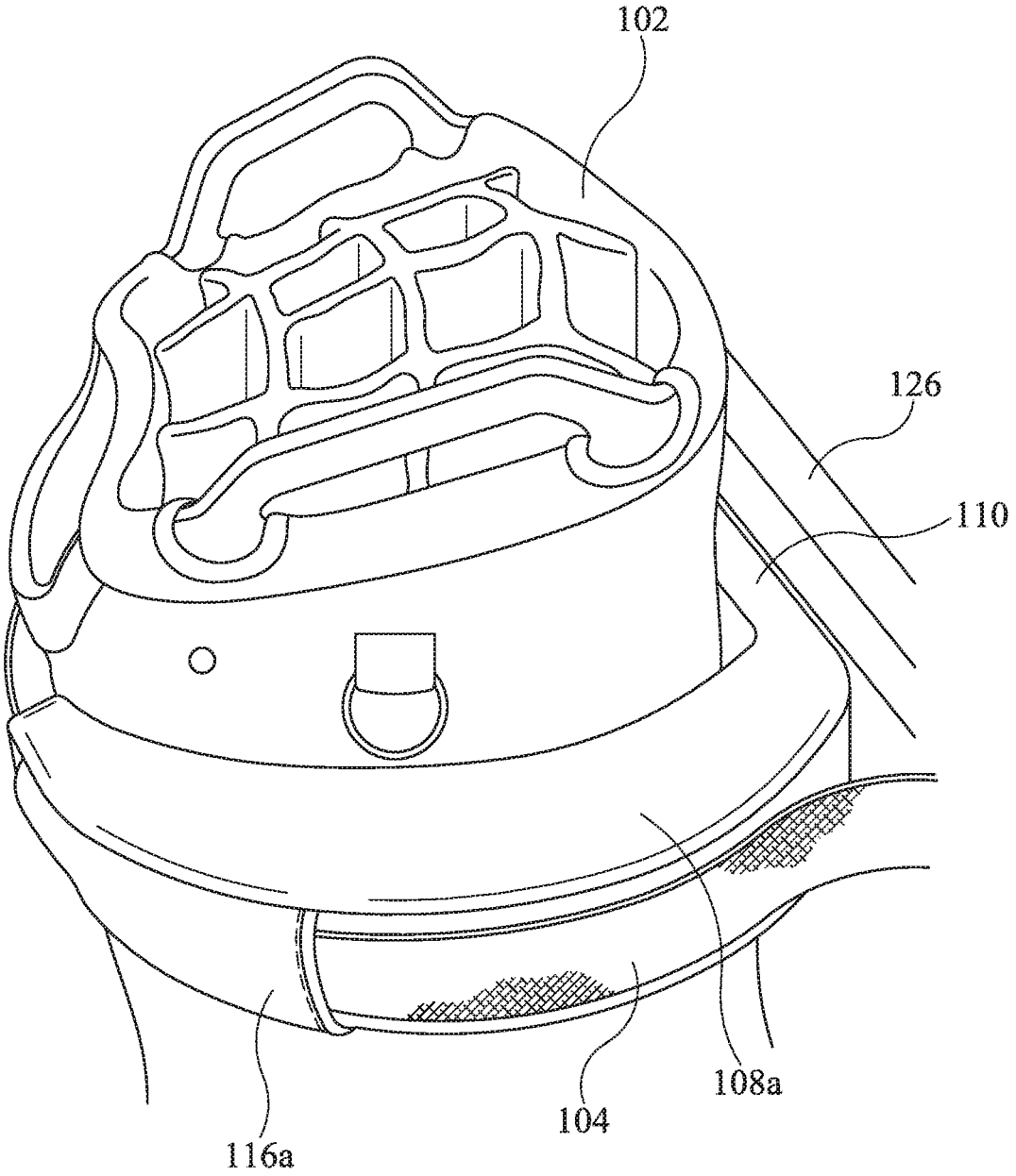
FIG. 2 is a side perspective view of the golf bag collar shown in FIG. 1 securing a golf bag to a golf cart.

Referring now to FIGS. 1 and 2, a particular illustrative embodiment of a golf bag collar is disclosed and generally designated 100. The golf bag collar 100 (also referred to hereinafter as "collar") is for securing around a golf bag 102 when attaching the golf bag 102 to a golf cart 106 using a strap 104.

A typical golf cart 106 includes a lower platform 107 for a bottom of the golf bag 102 to rest. The strap 104 is then used to wrap around a top of the golf bag 102 and buckled. As described above, the golf bag 102 will often list or slump making removing golf clubs from the golf bag 102 more difficult. Accordingly, with the golf bag collar 100 in place around the top of the golf bag 102, the strap 104 is passed through sleeves 116*a*, 116*b* on the golf bag collar 100 and secured. This configuration provides for a snug fit of the strap 104 via the golf bag collar 100 to the golf cart 106.

Thus, the golf bag 102 is held completely upright so that the golf clubs can be easily removed from the golf bag 102.

Figure 3:
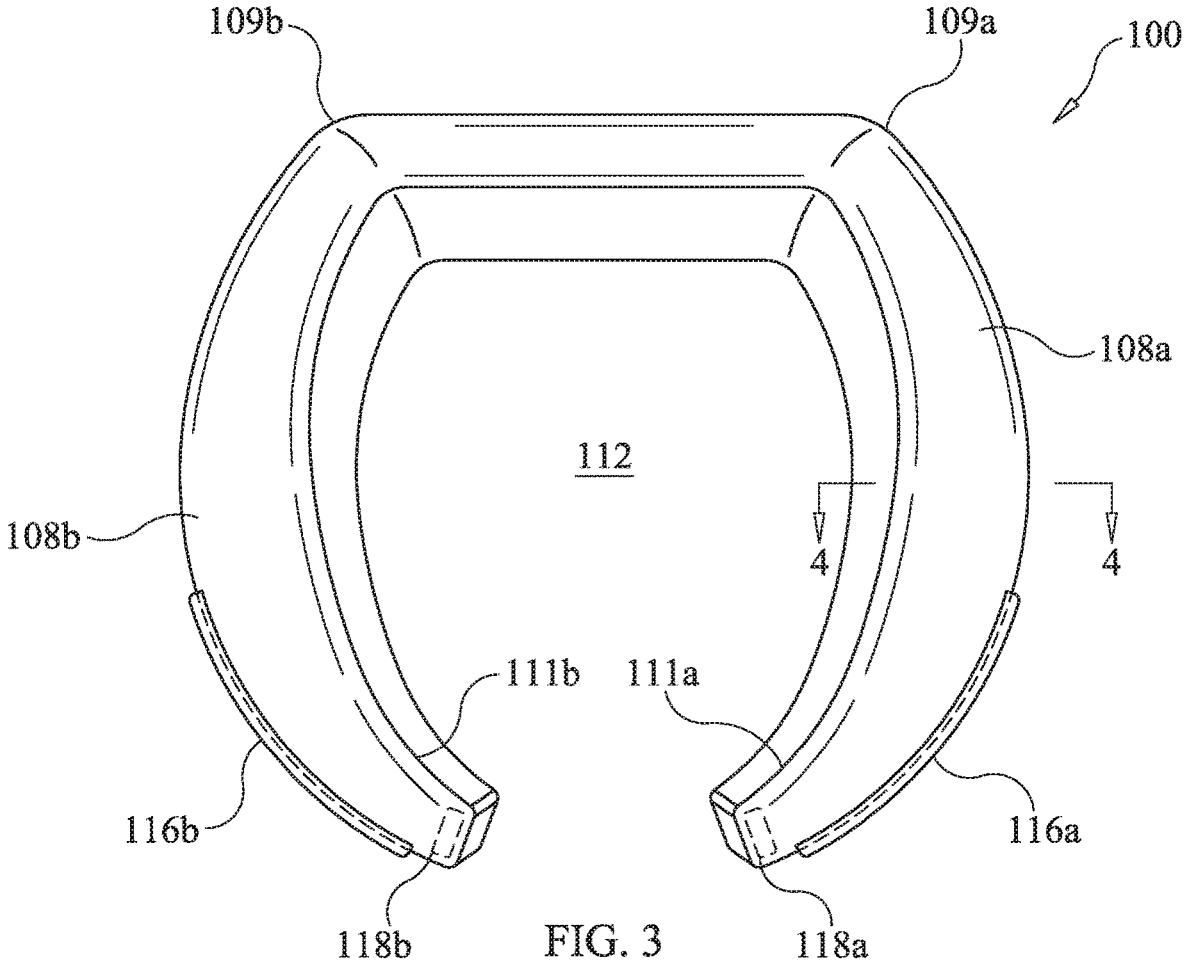
FIG. 3 is a top view of the golf bag collar shown in FIG. 1.

Referring now to FIG. 3, the golf bag collar 100 includes a first arcuate side member 108*a* having a first end 109*a* and a second free end 111*a*. The collar 100 also includes a second arcuate side member 108*b* which is a mirror image of the first arcuate member 108*a* and positioned opposing the first arcuate side member 108*a*. The second arcuate side member 108*b* also has a first end 109*b* and a second free end 111*b*.

In addition, the golf bag collar 100 includes a back member 110 connecting the first end 109*a* of the first arcuate member 108*a* to the first end 109*b* of the second arcuate member 108*b* to define a central aperture 112. The central aperture 112 has a shape to fit around an outside of the golf bag 102 as shown in FIG. 1 and the first and second arcuate side members 108*a*, 108*b* are held in place around the golf bag 102 by a golf cart strap 104.

Figure 4:
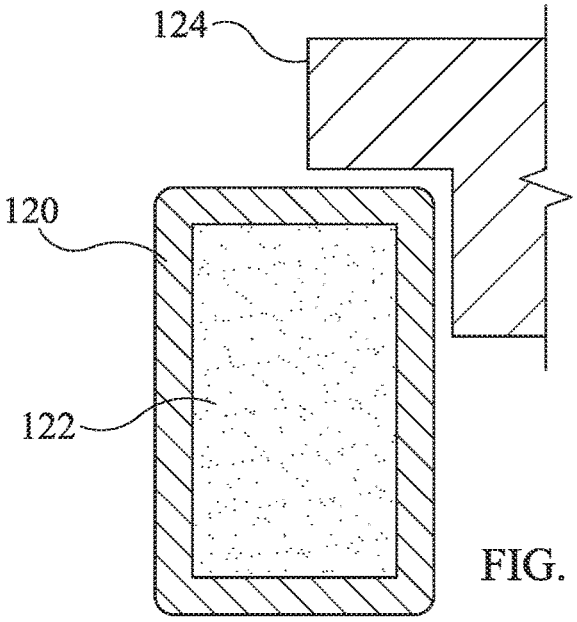
FIG. 4 is a cross sectional view of the system taken in the direction of line 4-4 of FIG. 3.

The golf bag collar 100 may have an outer cover 120 over the first and second arcuate side members 108*a*, 108*b* and the back member 110 as shown in FIG. 4 in cross section. The outer cover 120 may comprise leather or plastic, for example.

The golf bag collar 100 may also include a first sleeve 116*a* formed within the outer cover 120 on the first arcuate side member 108*a* proximate to its free second end 111*a*. Similarly, a second sleeve 116*b* may be formed within the outer cover 120 on the second arcuate side member 108*b* proximate to its free second end 111*b*. The first and second sleeves 116*a*, 116*b* extend at least partially to the first ends 109*a*, 109*b* of the respective arcuate side member 108*a*, 108*b* in order to selectively secure the strap 104 therethrough.

After the golf bag collar 100 is removed from the golf bag 102, the collar 100 can be used to wrap around the golf club shafts extending from the golf bag 102 in order to maintain the clubs in a tight configuration when the golf bag 102 is laid horizontal for transportation.

Top surfaces of the first and second arcuate side members 108*a*, 108*b* and the back member 110 may be substantially flat in order to slip up next to a rigid ledge 124 typically found on most golf bags 102 around the opening of the golf bag 102. The ledge 124 of the golf bag 102 can slide over a portion of a top surface of the golf bag collar 100 for support as shown in FIG. 4. In addition, the first and second arcuate side members 198*a*, 108*b* and the back member 110 may comprise a foam material 122, for example.

In a particular aspect, the second end 111*a*, 111*b* of each of the first and second arcuate side members 108*a*, 108*b* may also include a cooperating securement device 118*a*, 118*b* for selectively securing the respective second ends 111*a*, 111*b* of the first and second arcuate side members 108*a*, 108*b* together. The securement device 118*a*, 118*b* may include magnets, snaps, or hook and loop fasteners, for example.

Figure 5:
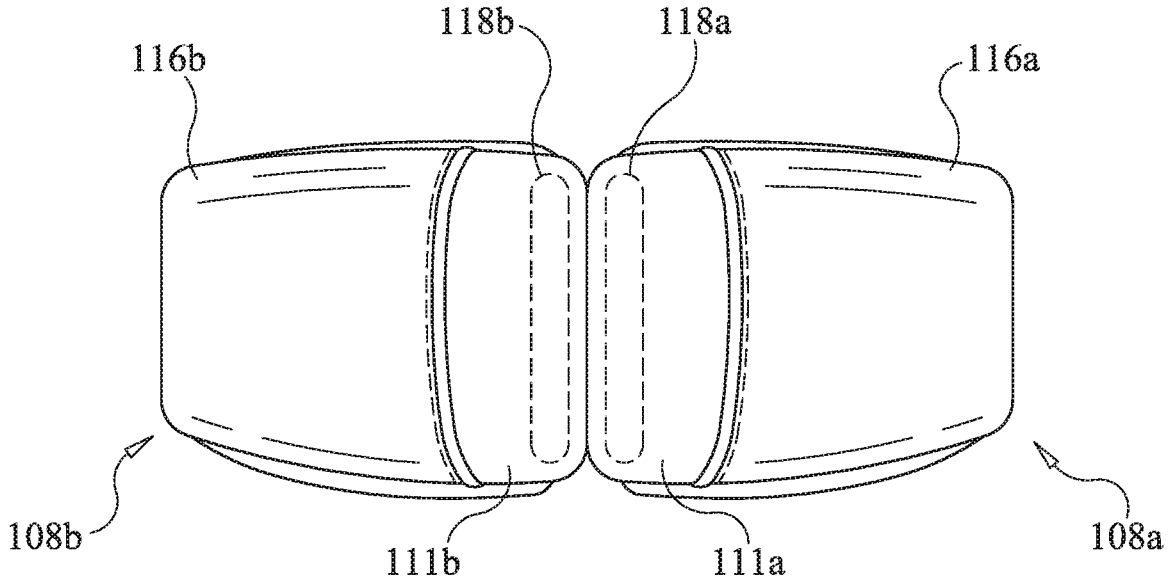
FIG. 5 is a front elevational view of the golf bag collar of FIG. 1 with free ends of the collar secured together.

Accordingly, inside the outer cover 120 a first magnet 118*a* having a first polarity may be positioned at the second end of the first arcuate side member 108*a*, and a second magnet 118*b* having a second polarity may be positioned at the second end of the second arcuate side member 108*b*. This allows the free second ends 111*a*, 111*b* to be held together as shown in FIG. 5 and forming a closed shape.

Figure 6:
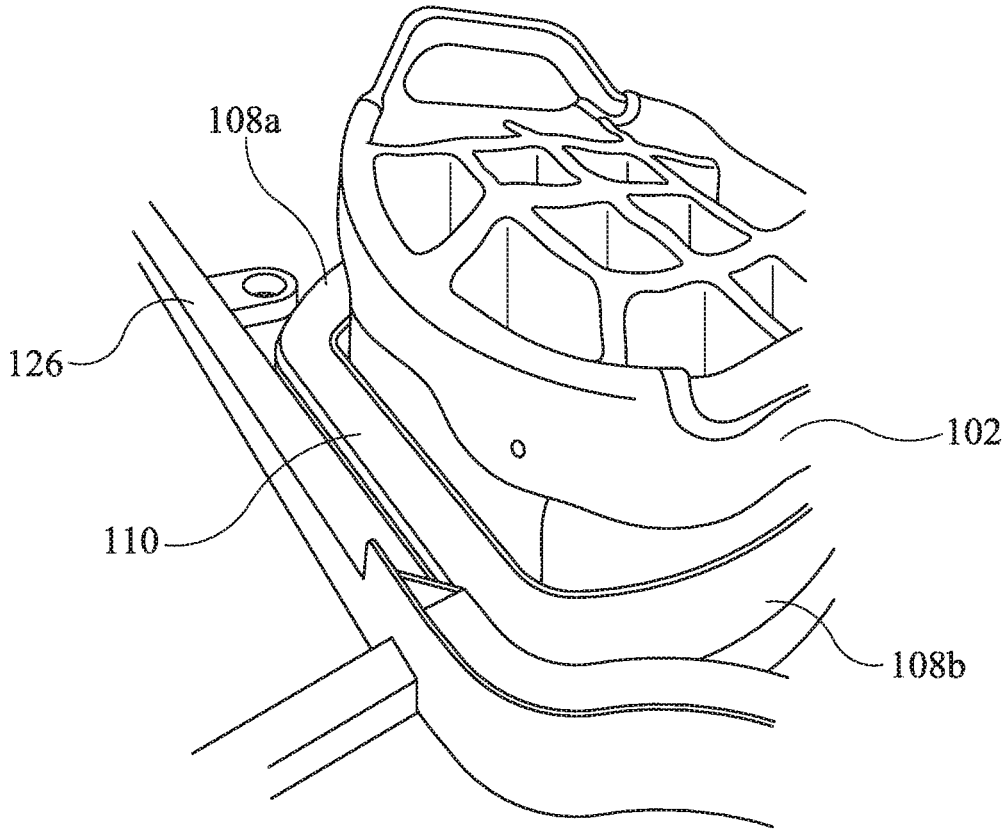
FIG. 6 is a rear perspective view of the golf bag collar shown in FIG. 1 securing a golf bag to a golf cart.

The back member 110 of the golf bag collar 100 may be substantially straight. In particular, the back member 110 will rest flat against a rail 126 mounted to a rear of the golf cart 106 as shown in FIG. 6. This helps to cradle the golf bag 102 on the golf cart 106.

The back member 110 may also include an elastic connector 110 that is adjustable at a back attachment point between the first ends 109*a*, 109*b* of the first and second arcuate member 108*a*, 108*b*, respectively. This feature allows for a diameter of an opening of the collar 100 to adjust from thirty to thirty-four inch bag sizes, which covers many golf cart designed bags as well other smaller golf bags.

The first and second arcuate members 108*a*, 108*b* preferably have a width of approximately four inches to help support the golf bag 102 completely upright. There is essentially no wasted room on either side of the golf bag collar 100 that may allow the bag 102 to teeter so that the collar 100 fits snug to the golf bag 102.

As explained above, the first and second arcuate members 108*a*, 108*b* may be comprised of foam or other similar material that is flexible enough to bend but firm enough to hold the golf bag 102 in place. The outer cover 120 of the golf bag collar 100 is comprised of a durable material that can withstand the elements and constant beating on a golf course. For example, the outer cover 120 may be comprised of fabric or leather that can withstand the weather.

In use, once the golf bag collar 100 is attached to the golf bag 102, the collar 100 can be adjusted to fit the golf bag 102 and keep it upright and stable in order for the golf clubs to be removed from the golf bag 102 and replaced with little effort. The strap 104 on the golf cart 106 is slipped through the sleeves 116*a*, 116*b* on each of the arcuate side members 108*a*, 108*b* proximate to a front of the golf bag collar 100 extending to the attachment provided on the golf cart 106. The strap 104 is configured to fasten the golf bag 102 snugly into position on the golf cart 106 around the golf bag collar 100.

In order to remove the golf bag collar 100, the strap 104 is pulled back out of the sleeves 116*a*, 116*b* on the collar 100 so that the collar 100 can be slipped upward to the clubs and pulling the collar together until the free ends 111*a*, 111*b* meet or overlap. Magnets 118*a*, 118*b* may be used as explained above or hook and loop fastener, such as Velcro, may be on the outside of the golf bag collar 100 in order to allow the collar 100 to be secured to itself and fit over the clubs to keep them from banging together while the golf bag 102 is being moved. The golf bag collar 100 does not have to be removed from the golf bag 102.

One of the most prominent reasons for damage to the golf clubs is the movement in the bag 102 while on the course and traveling causing the clubs to be jostled. Over time the surfaces of the clubs may be marred due to being jostled. The golf bag collar 100 as disclosed herein will significantly reduce the damage to clubs during travel.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A golf bag collar for securing around a golf bag when attaching the golf bag to a golf cart, the golf bag collar comprising:

a first arcuate side member having a first end and a free second end;

a second arcuate side member being a mirror image of the first arcuate member and positioned opposing the first arcuate member, the second arcuate member having a first end and a free second end; and a back member connecting the first end of the first arcuate member to the first end of the second arcuate member to define a central aperture;

an outer cover over the first and second arcuate side members and the back member;

wherein the central aperture has a shape to fit around an outside of a golf bag and the first and second arcuate side members are held in place around the golf bag by a golf cart strap.

2. The golf bag collar of claim 1, wherein the outer cover comprises leather or plastic.

3. The golf bag collar of claim 1, further comprising a first sleeve formed within the outer cover on the first arcuate side member proximate to its free second end, and a second sleeve formed within the outer cover on the second arcuate side member proximate to its free second end, the first and second sleeves extending at least partially to the first end of the respective arcuate side member in order to selectively secure a strap therethrough.

4. The golf bag collar of claim 1, wherein the second end of each of the first and second arcuate side members further comprises a securement device for selectively securing the respective second ends of the first and second arcuate side members together.

5. The golf bag collar of claim 4, wherein the securement device comprises magnets, snaps, or hook and loop fasteners.

6. The golf bag collar of claim 1, wherein top surfaces of the first and second arcuate side members and the back member are substantially flat.

7. The golf bag collar of claim 6, wherein the back member is substantially straight.

8. The golf bag collar of claim 7, wherein the first and second arcuate side members and the back member comprise foam material.

9. A golf bag collar for securing around a golf bag when attaching the golf bag to a golf cart, the golf bag collar comprising:

a U-shaped member comprising first and second legs connected by a rear portion, the U-shaped member defining a central aperture to fit around an outside of a golf bag, a top surface of the U-shaped member being substantially flat and a back portion of the U-shaped member being substantially straight; and an outer cover over the U-shaped member.

10. The golf bag collar of claim 9, wherein the outer cover comprises leather or plastic.

11. The golf bag collar of claim 9, further comprising a first sleeve formed within the outer cover on the first leg of the U-shaped member, and a second sleeve formed within the outer cover on the second leg of the U-shaped member, the first and second sleeves positioned to selectively secure a strap therethrough.

12. The golf bag collar of claim 11, wherein each free end of the first and second legs of the U-shaped member comprises a securement device for selectively securing the respective second ends together.

13. The golf bag collar of claim 12, wherein the securement device comprises magnets, snaps, or hook and loop fasteners.

14. The golf bag collar of claim 9, wherein the first and second legs of the U-shaped member comprise foam material.

15. The golf bag collar of claim 9, wherein the rear portion is substantially straight and having a length between about eight and ten inches.

16. The golf bag collar of claim 9, wherein a thickness of the U-shaped member is about four inches.

17. The golf bag collar of claim 9, wherein the rear portion comprises an elastic material to adjust a width between the first and second legs in order to fit different sizes of golf bags.

18. A golf bag collar for securing around a golf bag when attaching the golf bag to a golf cart, the golf bag collar comprising:

a U-shaped member comprising first and second legs connected by a rear portion, the U-shaped member defining a central aperture to fit around an outside of a golf bag, a top surface of the U-shaped member being substantially flat and a back portion of the U-shaped member being substantially straight;

a first sleeve on the first leg of the U-shaped member;

and a second sleeve on the second leg of the U-shaped member, the first and second sleeves positioned to selectively secure a strap therethrough;

wherein the U-shaped member comprises foam material.

* * * * *